US009572461B2

(12) United States Patent
Larsson et al.

(10) Patent No.: US 9,572,461 B2
(45) Date of Patent: Feb. 21, 2017

(54) DISPENSER FOR A CENTER FEED ROLL

(75) Inventors: Björn Larsson, Göteborg (SE); Inger Andersson, Varberg (SE)

(73) Assignee: SCA HYGIENE PRODUCTS AB, Göteborg (SE)

( * ) Notice: Subject to any disclaimer, the term of this patent is extended or adjusted under 35 U.S.C. 154(b) by 0 days.

(21) Appl. No.: 14/421,880

(22) PCT Filed: Aug. 29, 2012

(86) PCT No.: PCT/EP2012/066737

§ 371 (c)(1),
(2), (4) Date: Feb. 16, 2015

(87) PCT Pub. No.: WO2014/032706

PCT Pub. Date: Mar. 6, 2014

(65) Prior Publication Data

US 2015/0216377 A1 Aug. 6, 2015

(51) Int. Cl.

| | |
|---|---|
| ***A47K 10/38*** | (2006.01) |
| *B65D 85/00* | (2006.01) |
| *A47K 10/32* | (2006.01) |

(52) U.S. Cl.

CPC ... *A47K 10/3818* (2013.01); *A47K 2010/3206* (2013.01); *B65D 85/00* (2013.01)

(58) Field of Classification Search

USPC ..... 242/588, 588.3, 588.5, 595, 596, 596.1,242/596.3, 596.8, 598.5, 598.6, 402, 405, 597.8

See application file for complete search history.

(56) References Cited

U.S. PATENT DOCUMENTS 3,282,525 A * 11/1966 Rehr ..... B23D 19/065 242/160.2
4,013,240 A * 3/1977 Perrin ..... A47K 10/36 242/559.1

(Continued)

FOREIGN PATENT DOCUMENTS

CN 1901830 A 1/2007
CN 101040764 A 9/2007

(Continued)

OTHER PUBLICATIONS

International Search Report (PCT/ISA/210) mailed on May 28, 2013, by the European Patent Office as the International Searching Authority for International Application No. PCT/EP2012/066737.

(Continued)

*Primary Examiner* — Emmanuel M Marcelo
*Assistant Examiner* — Michael Gallion
(74) *Attorney, Agent, or Firm* — Buchanan Ingersoll & Rooney PC

(57) ABSTRACT

A dispenser for a roll of web material, such as a center feed roll includes: a body having a first end wall provided with a dispensing opening for dispensing a leading end of the web material at the center of the roll, a second end wall opposite to the first end wall, and a sidewall connecting to the first and second end wall. The dispenser also includes a stabilizing device that is insertable into the roll to prevent the roll from collapsing towards its center. The stabilizing device includes a plurality of protrusions protruding from at least one of the first or second end wall towards the other of the first or second end wall, and the protrusions are disposed closer to the sidewall than to a center axis of the body.

16 Claims, 1 Drawing Sheet

(56) References Cited

U.S. PATENT DOCUMENTS

| | | | | | |
|---|---|---|---|---|---|
| 4,171,047 | A * | 10/1979 | Doyle | A47K 10/3818 | 118/506 |
| 4,787,513 | A * | 11/1988 | Auble | G03B 27/588 | 206/407 |
| 5,205,455 | A * | 4/1993 | Moody | A47K 10/3818 | 206/409 |
| 5,215,211 | A | 6/1993 | Eberle | | |
| 5,294,068 | A * | 3/1994 | Baro | B26F 3/02 | 206/405 |
| 5,785,274 | A | 7/1998 | Johnson | | |
| 6,179,235 | B1 * | 1/2001 | King | A47K 10/3818 | 242/160.1 |
| 6,575,397 | B1 * | 6/2003 | Tramontina | A47K 10/3818 | 206/409 |
| 6,964,395 | B1 * | 11/2005 | Lewis | A47K 10/3818 | 242/593 |
| 7,997,522 | B2 * | 8/2011 | Titas | A47K 10/3818 | 221/33 |
| 9,027,872 | B2 * | 5/2015 | Flood | A47K 10/3827 | 206/409 |
| 2006/0000941 | A1 * | 1/2006 | Lewis | A47K 10/38 | 242/596 |
| 2007/0054557 | A1 * | 3/2007 | Larsson | B29C 45/0017 | 439/607.41 |
| 2012/0032565 | A1 * | 2/2012 | Stoop | A47K 10/3818 | 312/34.4 |

FOREIGN PATENT DOCUMENTS

| | | | |
|---|---|---|---|
| EA | 200801192 | A1 | 10/2008 |
| EP | 0107487 | A1 | 5/1984 |
| EP | 0480848 | A1 | 4/1992 |
| EP | 1826147 | A2 | 8/2007 |
| EP | 2512314 | B1 | 10/2012 |
| RU | 2435512 | C2 | 12/2011 |
| WO | WO 98/25848 | A1 | 6/1998 |
| WO | WO 00/11998 | A1 | 3/2000 |
| WO | 2005/063103 | A1 | 7/2005 |
| WO | 2011/072757 | A1 | 6/2011 |

OTHER PUBLICATIONS

Written Opinion (PCT/ISA/237) mailed on May 28, 2013, by the European Patent Office as the International Searching Authority for International Application No. PCT/EP2012/066737.

Notification of the First Office Action dated Sep. 2, 2015 issued by the Chinese Patent Office in corresponding Chinese Patent Application No. 201280076080.8 and English language translation (7 pages).

Decision on Grant dated Jun. 24, 2016 issued in corresponding Russian Patent Application No. 2015111153/12 and English translation (13 pages).

* cited by examiner

DISPENSER FOR A CENTER FEED ROLL

TECHNICAL FIELD

The present disclosure relates to a dispenser for a roll of web material, particularly a roll having a circumferential outer surface and a first and second end, each being composed of edges of the web material and defining an opening that extends through the roll along a central axis, wherein the web material is to be dispensed from the central axis towards the circumferential outer surface and wherein the roll remains stationary within the dispenser. Thus, the present dispenser particularly relates to a dispenser for a center feed roll.

BACKGROUND

It is well known with respect to the aforesaid dispensers, that the roll of web material tends to collapse towards its center axis, particularly when a considerable proportion of the web material of the roll has already been dispensed from the center of the roll, whereby the dispensing process is interfered.

To counteract collapsing, WO 98/25848 A1 suggests to statically compress the roll between the opposite end walls of the dispenser to a degree sufficient to prevent collapsing.

Further, WO 2000/011998 A1 suggests to stiffen at least a region of the web material at at least one end of the roll by adding moisture and allowing the moisture to dry, whereby the separate sheets of the web material adhere to each other at said end in order to prevent collapsing.

EP 0 107 487 A1 and U.S. Pat. No. 5,215,211 A both suggest a protrusion depending from an upper end wall of the dispenser and insert into the void at the center of the roll.

Even though the above solutions provide satisfying results, statically compressing the roll to a certain degree requires the user to correctly refill and assemble the dispenser. At the same time, the distance between the opposite end walls of the dispenser need to remain exactly the same over the entire lifetime of a dispenser which will require a certain rigidity and durability. This, however, may increase the manufacturing costs.

Treating the roll itself leads to an additional step of manufacturing of the paper roll.

Furthermore, the stabilizing devices with protrusions inserted into the void at the center of the roll have shown good results at the beginning of depletion of the web material from the roll but do not show satisfactory results once a rather high proportion of the roll has already been dispensed from the center of the roll.

BRIEF DESCRIPTION

In view of the aforesaid, it is the object of the present disclosure to provide a dispenser for a roll of web material which improves the stabilization of the paper roll even if a considerable proportion of the roll has been dispensed from the roll at the same time keeping the complexity of the manufacturing process of the dispenser as well as of the paper roll as low as possible.

This object of the present disclosure is achieved by a dispenser having the features in the embodiments discussed below.

The basic idea of the present disclosure is to provide two or more protrusions located inbetween the center and the sidewall of the dispenser (the circumferential surface of the roll) so that the protrusions insert between adjacent layers of the web material defining the roll rather than to provide a center protrusion inserting into the void at the center of a roll. Thus, the protrusions are effective at a position closer to the circumferential surface of the roll than to its center, whereby the roll may be supported even if a considerable amount of web material has already been dispensed from the center of the roll. In addition, the disadvantages regarding a statical compression of the roll and treatment of the roll as mentioned in the introductory portion may be prevented, because the protrusions may even be integrally formed in an injection molding process of the dispenser reducing the manufacturing costs of the dispenser. Further, the protrusions do not require any reconfiguration of the roll to be used with the inventive dispenser.

A dispenser of the present disclosure is configured for a roll of web material. The web material may be made of non-woven or tissue paper and be a continuous web or be defined by a plurality of sheets, which are interconnected by means of perforation or other weakening. Preferably, the dispenser is configured for a roll of web material having a circumferential surface and opposite ends formed by the respective edges of the web material with an opening being provided and extending entirely through the roll at its center axis. The roll of web material preferably has a trailing edge positioned at the outer circumference of the roll and a leading edge provided at the center of the roll, wherein the web material is dispensed starting at the leading edge at the center of the roll. The dispenser may, in principle, be made of any material, but an injection moldable material such as plastic or resin is preferred. The dispenser may be partially or fully transparent. Further, the dispenser may have any outer shape. However, a partial or full substantially cylindrical shape is preferred. The term "substantially" in this regard emphasizes that the outer shape does not necessarily be cylindrical from a geometric point of view but that also variations from the cylindrical shape may occur such as that the cylinder side (barell) does not extend parallelly but in a conical manner. Self-speaking, also other outer shapes such as a rectangular basic shape are conceivable. Further, the dispenser may have a circular, oval, rectangular or any other cross-section. Thus, the dispenser comprises a body having a first end wall, which may in use act as a bottom wall on which an end of the roll directly or indirectly rests. The first end wall is provided with a dispensing opening for dispensing the leading end of the web material at the center of the roll. The dispensing opening is provided in the first end wall so that the leading end of the web material may be gripped at the center of the roll and be extracted through the dispensing opening. For this purpose, it may be advantageous that the dispensing opening is positioned in the center of the first end wall. Furthermore, a second end wall is provided opposite and in a distance to the first end wall. The second end wall may in use define the top wall wherein the upper edge of the roll may remain in a distance to the top wall in use. Further, a sidewall connecting to the first and second end wall is provided. In this context, the sidewall may directly or indirectly, e.g. via other elements, connect to the first and/or second end wall. The sidewall may even be split in a direction between the first and second end wall in order to enable opening of the dispenser as it will be described later. As previously mentioned, the problem adhering to dispensers for center feed rolls is that the rolls tend to collapse once a certain proportion of web material has already been dispensed from the center of the roll whereby the remaining layers of the web material fall towards the center of the roll so that the roll loses its cylindrical shape. To prevent this collapsing, the present disclosure suggests a stabilizing device which is insertable into the roll. Insertable in this context means, that at least part of the stabilizing device is in use located between the opposite end faces of the roll in an axial direction of the roll. For this purpose, the stabilizing device of the present disclosure comprises a plurality of protrusions, preferably three or more and even more preferred four or more protrusions protruding from the first or second end wall towards the other of the first or second end wall or protruding from both the first and the second end wall towards the other of the first or second end wall. These protrusions are disposed closer to the sidewall than to the center axis of the body. In use, the protrusions are, thus, disposed closer to the circumferential surface of the roll than to the center axis of the roll. As a result, the protrusions do not extend into the void at the center of the roll but may be engaged with the web material at a position closer to the circumferential surface of the roll, thereby supporting the outer layers of the web material and maintaining the cylindrical shape of the roll even in case a considerable amount of web material has already been dispensed.

It has been proven advantageous to provide the plurality of protrusions at least on the second end wall so that they protrude from the second end wall towards the first end wall. As previously indicated, the dispenser is usually used with the first end wall being directed downward and the second end wall being directed upward. Thus, the roll directly or indirectly rests on the first end wall so that the roll is already by gravity supported in a sufficient manner by the first end wall but tends to collapse at the opposite upper end. To prevent this collapsing, it is preferred to provide the plurality protrusions at least at the second end wall. Further, it has been proven, that the protrusions may be omitted at the first end wall, if the roll actually rests on the first end wall in use so that according to one embodiment, the plurality of protrusions only protrude from the second end wall towards the first end wall.

In order to enable a good insertability of the protrusions inbetween the separate layers of web material, it is preferred that the protrusions are formed as ribs extending in a substantially circumferential direction with respect to the center axis of the body or in use the roll rather than radially. As the ribs preferably have a linear extension in cross-section and are not bent, the term "substantially" has been used with respect to the circumferential extension of the ribs. Accordingly, the protrusions preferably have a thickness in a direction perpendicular to the center axis of the body and a width in a direction substantially parallel to the center axis of the body, wherein the protrusions are substantially flat with the thickness being less than the width. However, it may as well be conceivable to configure the protrusions with a conical or truncated conical shape rather than a flat rib shape.

Even further, it may be advantageous to form the protrusions in a substantially triangular or trapezoidal form, that is similar to a spike, the tooth of a star or a shark fin, which facilitates the inserting process inbetween the adjacent layers of web material. Thus, it is preferred, that the width of the protrusions decreases from the first or second end wall towards the other of the first or second end wall. In other words, the protrusions are configured with a tapered shape in this direction. Yet, it may also be conceivable to provide the protrusions with a constant width. Also other shapes are conceivable having a base and a tip so as to protrude into the roll. The tip may be pointed or rounded or even be flat.

Furthermore, and in order to provide sufficient support of the roll at different degrees of depletion of the web material from the center of the roll, it may be advantageous to provide the protrusions at a different distance to the center of the body or in use the center of the roll. For example, a first group of protrusions may be provided at a first distance to the center of the body and a second group of protrusions may be provided at another distance to the center of the body. In this context, the distance between the protrusions and the body is a distance in a radial direction perpendicular to the center axis of the body. Even further, a third group of protrusions may be positioned at a different distance to the first and second group relative to the center of the body and so forth.

Further, and according to one embodiment, at least two of the protrusions may be positioned on a common circle, wherein the center of the circle is coextensive with the center axis of the body. Referring to the previous embodiment it may be conceivable to have a first group of protrusions positioned on a first circle and a second group of protrusions positioned on a second circle coaxial with the first circle. Self-speaking, more than two groups may be provided as well. If the protrusions are positioned on a common circle, one particular layer of web material may be supported at a plurality of circumferential positions improving support of the roll to maintain its cylindrical shape. If more than one group is provided, this effect may be obtained at different radial positions of the roll.

In order to ensure that the protrusions actually insert between the web material at an end face of the roll, the dispenser is configured so that the distance between the first end wall and the second end wall is configured so that one end of the roll may rest directly or indirectly on the first end wall in use and is distanced from the second end wall with a distance shorter than the length of the protrusions in the direction from the second end wall towards the first end wall. Because of the distance between the end of the roll and the second wall, compression of the roll may be prevented in use. Because the distance between the support face of the roll at the first end wall and the second end wall is, however, selected to be shorter than the height of the roll between the first and second end wall of the roll added by the length of the protrusions, it is ensured that the protrusions insert between the web material at the end face of the roll facing the second end wall.

For ease of manufacture and reducing assembly at the manufacturing site, it is preferred that the protrusions are integrally formed with the first and/or second end wall. The dispenser including the protrusion may e.g. be formed by an injection molding process. Yet, the protrusions may as well be separately formed and then made from the same or a different material than the respective end wall, such as metal, paperboard, plastic or the like.

Further, and in order to enable refilling of the dispenser one of the first or second end wall, preferably the first end wall is part of a lid detachable from the remainder of the body. By opening (detaching) the lid from the remainder of the body, a new roll of web material may be inserted into the dispenser. The lid may also comprise part of the sidewall to further facilitate the refilling process as previously mentioned.

Further features and embodiments will become apparent from the following description of a particular working example. These features may be implemented in combination with one or more of the above features unless the features contradict each other. Self-speaking it is also conceivable to only implement some of the features of the following working example with one or more of the features described above, unless the features contradict each other.

BRIEF DESCRIPTION OF THE DRAWINGS

The following description of a working example makes reference to the accompanying drawings in which.

DESCRIPTION OF A WORKING EXAMPLE

Figure 1:
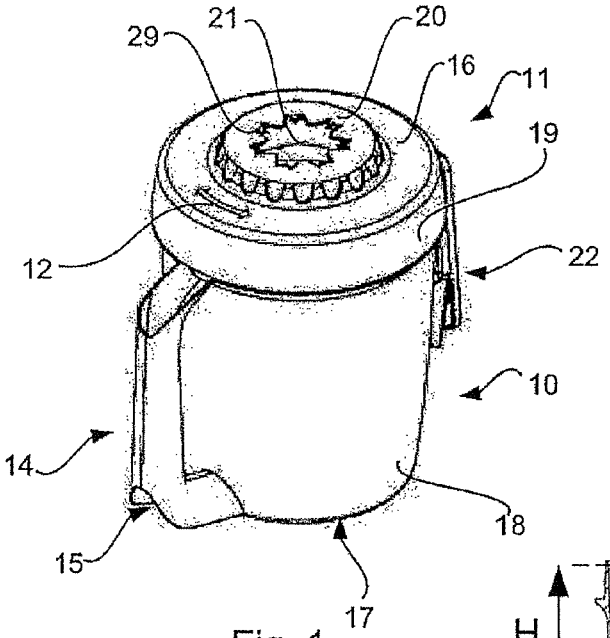
FIG. 1 shows a perspective view of a dispenser according to an embodiment.

The dispenser of the particular working example is made of transparent plastic having two parts, a lower part 10 and an upper part 11. The upper part 11 is formed as a lid that may be detached from the lower part 10 by rotation as indicated by the double arrow 12. For this purpose, the lower part 10 and the lid 11 may be engageable by a means of a bayonet coupling one part 13 being visible in FIG. 2. However, other coupling mechanisms are conceivable as well.

Further, the lower part comprises a handle 14 enabling transportation of the dispenser from one location to another. Preferably, the lower part 10 and the upper part 11 are each made of one piece in an injection molding process. In order to enable removal of the lower part 10 from the mold, the handle has a hollow interior 15 which is accessible at opposite ends in a vertical direction.

The lid (upper part) 11 has a first end wall 16, which in a plan view is in the particular embodiment configured circular. In use the first end wall 16 will in most cases be directed downwards so that the first end wall 16 may also be referred to as the bottom wall. Nevertheless, the dispenser may as well be used in the orientation shown in FIG. 1 or with its center axis C (see FIG. 2) directed horizontally.

The lower part 10 has a second end wall 17 opposite to the first end wall 16. In use, the second end wall 17 will in most cases be directed upward and may therefore also be referred to as the top wall.

The first end wall 16 and the second end wall 17 are disposed opposite to each other and connected to a sidewall being defined by a lower sidewall 18 being part of the lower part 10 and an upper sidewall 19 being part of the lid 11. That side of the first end wall 16 that faces away from the second sidewall 17 is provided at its center with a dome-shaped portion 20. A dispensing opening 21 is provided in the center of the dome-shaped portion 20 or in the center of the first end wall 16. That side of the first end wall 16 facing towards the second end wall 17 forms a support face supporting one end of the roll 40 in use. The support face may be formed by a planar face of the first end wall 16, but may as well be formed by a plurality of radially extending ribs provided on the side of the first end wall 16 facing the second end wall 17, wherein the end 41 of the roll 40 rests on the edge of the rib facing away from the first end wall 16, when the dispenser is oriented as shown in FIG. 1.

Figure 2:
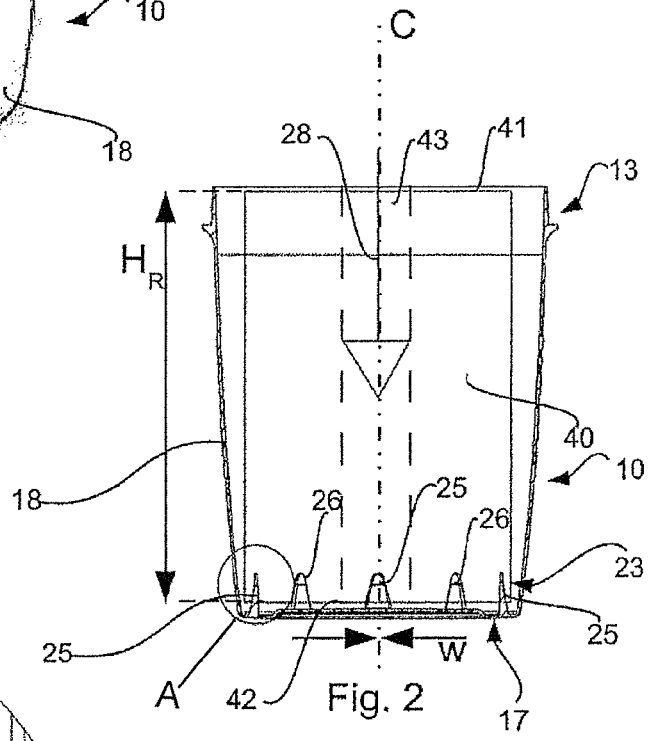
FIG. 2 shows a longitudinal cross-section through the center axis of the body of the dispenser shown in FIG. 1 with lid being removed.

As will be best visible from FIG. 2, the lower part 10 has a substantially cylindrical form with the sidewall 18 being slightly curved and tapering towards the second end wall 17. Thus, the lower part 10 is cup-shaped. This, however, is to be understood to be encompassed by the wording substantially cylindrical shape.

The dispenser may be provided with a device for enabling to releasably hang the dispenser on a vertical or horizontal support surface. For this purpose, a schematically shown docking station 22 may be provided with one part being attached to the dispenser and the other part being configured for attachment to a mounting surface, e.g. a vertical wall.

Further, a stabilizing device is provided at the side of the second end wall 17 facing the first end wall 16. The stabilizing device comprises a plurality of protrusions 23. In the particular example, eight such protrusions are provided.

Each of the protrusions 23 is formed as a rib with a width W parallel to the center axis C and a thickness T perpendicular to the center axis C. The width W is larger than the thickness T so that the protrusions 23 are flat and extend in a circumferential direction. The width is measured in the circumferential direction, whereas the thickness is measured in the radial direction.

The protrusions 23 are not bent along the circumferential direction, but extend linearly so that the width only substantially extends in the circumferential direction, i.e. tangential to a circle coinciding with the center axis C. Yet, the protrusions 23 may as well be bet in the circumferential direction.

As is best visible from FIG. 2, the protrusions are in a view in the radial direction formed triangularly with a rounded tip. Thus, the width W decreases from the connection of the protrusions 23 to the second end wall 17 in a direction towards the first end wall 16.

Figure 3:
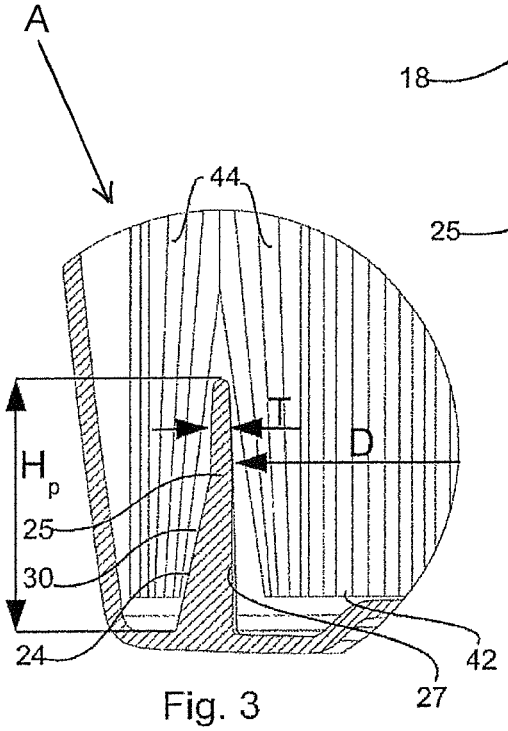
FIG. 3 shows a portion A of FIG. 2 with an enlarged scale.

Referring to FIG. 3, the protrusions 23 may be formed integrally with the lower part 10 of the dispenser. Thus, the manufacturing costs of the dispenser are not increased and no assembly time is required. Furthermore, the protrusions 23 are supported by an integral rib 24 stiffening the protrusions 23. The rib is preferably provided at a radially outer side of the protrusions 23 and best visible from FIG. 3.

In the particular embodiment, two groups of protrusions 23 are provided, a first group comprising four protrusions 25 and a second group comprising four protrusions 26. The protrusions 25 and 26 of the two groups are positioned diametrically opposite to each other. The distance D between the inner face 27 of the protrusions 25 to the center axis is larger than the distance D from the inner face 27 of the protrusions 26 to the center axis C. The distance is measured from the inner face 27 of the protrusions in a radial direction. Thus, the protrusions 25 are positioned on a first common circle, whereas the protrusions 26 are positioned on a second common circle. The first and second circle are positioned coaxial to each other and to the center axis C.

The roll 40 is made of a web material, preferably non-woven or tissue paper and may consist of a plurality of interconnected sheets. The web material is rolled and ends 41 and 42 are formed by the edges of the web material. An opening 43 extends through the entire roll at the center of the roll 40. A plurality of adjacent layers 44 of web material are formed when forming the roll.

The distance between the support face (not shown) of the first end wall 16 and the face of the second end wall 17 facing the support face is selected to be less than the height $H_R$ of the roll 40. Thus, even in use, the roll 40 is not compressed between the support face of the first end wall 16 and the second end wall 17.

In addition, the height $H_p$ of the protrusions 23 is selected so that the protrusions 23 are insertable at an end face 42 of the roll 40 between the layers 44 of the web material. In other words, the distance between the support faces of the first and second end wall 16, 17 minus the height $H_p$ of the protrusions is less than the height $H_R$ of the roll 40.

In the following, use of the dispenser described above will be explained.

In order to insert a roll 40 into the dispenser, the lid 11 has to be detached. Subsequently, a roll 40 is inserted into the lower part 10 in the direction of the arrow 28 in FIG. 2. By pushing the roll 40 in this direction, the end face 42 engages with the tips of the protrusions 23, whereby the protrusions 23 enter inbetween adjacent layers 44 of web material as best visible from FIG. 3. Subsequently, the lid 11 is again attached to the lower part 10. While attaching the lid 11, the leading end of the web material of the roll 40 at the center, i.e. in the opening (void) 43, is to be gripped and to be threaded through the dispensing opening 21 so that the leading end protrudes from the dispensing opening 21 and may be gripped. Subsequently, a user may separate a portion of the web material either at a perforation or if no perforations are present by means of the teeth 29 of the dispensing opening 21.

Once a considerable amount of web material has been dispensed, the opening 43 in the center of the roll 40 more or less coinciding with the center axis C of the body of the dispenser becomes larger in diameter. Nevertheless, the protrusions 23 maintain the layer 44 of web material disposed on the radially outer side of the protrusions in its position so as to prevent these layers from collapsing towards the center axis C. At the beginning, both, the protrusions 26 of the first group and the protrusions 25 of the second group are active in the supporting corresponding layers of web material 44. Once the diameter of the opening 43 however reaches the outer side 30 of the protrusions 26, the protrusions become less active. Yet, if the radially inner protrusions 26 become less effective, sufficient support is still provided by the radially outer protrusions 25.

Thus, the protrusions effectively prevent collapsing of the roll 40 even if a large amount of web material is already dispensed.

Further, the protrusions do not require any treatment or reconfiguration of the roll 40, but common rolls as presently on the market may be used in combination with the present dispenser. Thus, the dispenser does not only improve the stabilizing device for preventing collapsing of the roll once a considerable amount of web material has already been depleted but also provides a very cost-effective and simple solution.

Nevertheless, as will be clear from the above, the present disclosure is not to be limited to the particular working example but several modifications and variations are conceivable within the scope of the following claims.

The invention claimed is:

1. A dispenser for a roll of web material, the dispenser comprising:

a body having a first end wall provided with a dispensing opening for dispensing a leading end of the web material at a center of the roll, a second end wall opposite to the first end wall, and a sidewall connecting to the first end wall and the second end wall; and a stabilizing device insertable into the roll to prevent the roll from collapsing towards the center of the roll, wherein the stabilizing device comprises a plurality of protrusions protruding from at least one of the first end wall and the second end wall towards the other of the first end wall and the second end wall, the protrusions being disposed closer to the sidewall than to a center axis of the body and configured to be inserted between adjacent layers of the web material, wherein at least two of the protrusions are separated from each other and positioned on a surface of one of the first end wall or the second end wall in a common circle, the center of the circle being coextensive with the center axis of the body.

2. The dispenser according to claim 1, wherein the plurality of protrusions protrudes from the second end wall towards the first end wall.

3. The dispenser according to claim 1, wherein the protrusions have a thickness in a direction perpendicular to the center axis of the body and a width in a direction substantially parallel to the center axis of the body, the protrusions being substantially flat with the thickness being less than the width.

4. The dispenser according to claim 3, wherein the width of the protrusions decreases from one of the first end wall and the second end wall towards the other of the first end wall and the second end wall.

5. The dispenser according to claim 1, wherein at least two of the protrusions are positioned at a different distance to the center axis of the body.

6. The dispenser according to claim 1, wherein a distance between the first end wall and the second end wall is configured so that the protrusions are insertable between the web material at an end face of the roll.

7. The dispenser according to claim 1, wherein the protrusions are integrally formed with at least one of the first end wall and the second end wall.

8. The dispenser according to claim 1, wherein one of the first end wall and the second end wall is part of a lid that is detachable from a remainder of the body.

9. The dispenser according to claim 8, wherein the first end wall is part of the lid.

10. The dispenser according to claim 1, wherein the plurality of protrusions protrudes from each of at least one of the first end wall and the second end wall.

11. The dispenser according to claim 1, wherein each of the plurality of protrusions is spaced at an interval in a direction around the circle from an adjacent one of the plurality of protrusions.

12. The dispenser according to claim 1, wherein a first group of two or more of the plurality of protrusions is positioned on the common circle and a second group of two or more of the plurality of protrusions is positioned on a second common circle.

13. The dispenser according to claim 1, wherein the plurality of protrusions includes a first group comprising four protrusions and a second group comprising four protrusions.

14. The dispenser according to claim 1, wherein the plurality of protrusions includes at least three separate protrusions.

15. The dispenser according to claim 1, wherein a circumferential distance between each of the separated protrusions is larger than a length of each of the separated protrusions.

16. The dispenser according to claim 1, wherein each of the protrusions has an inner-facing side facing toward the center axis of the body and an opposite outer-facing side facing away from the center axis of the body, wherein the inner-facing side comprises a first wall having a first angle relative to the first end wall or the second end wall, the outer-facing side comprises a second wall having a second angle relative to the first end wall of the second end wall, the second angle being different than the first angle, and a third wall having a third angle relative to the first end wall or the second end wall, the third angle being different than the first angle and the second angle.

* * * * *